US005122411A

United States Patent [19]

Iwamoto et al.

[11] Patent Number: 5,122,411

[45] Date of Patent: Jun. 16, 1992

[54] ELECTROSTATIC RECORDING MATERIAL

[75] Inventors: Kiyoshi Iwamoto; Tomio Oki; Yoshiaki Kaburaki; Keno Kamimura, all of Shizuoka, Japan

[73] Assignee: Tomoegawa Paper Co., Ltd., Tokyo, Japan

[21] Appl. No.: 561,466

[22] Filed: Aug. 1, 1990

[30] Foreign Application Priority Data

Aug. 4, 1989 [JP] Japan ..... 1-201313

[51] Int. Cl.[5] ..... G03G 15/00

[52] U.S. Cl. ..... 428/257; 428/225; 428/245; 428/246; 428/252; 428/253; 428/260; 428/262; 428/263; 428/265; 428/272; 428/936; 428/937; 428/938; 428/908; 428/909

[58] Field of Search ..... 428/225, 936, 937, 938, 428/908, 909, 245, 246, 252, 253, 257, 260, 262, 263, 265, 272

[56] References Cited

U.S. PATENT DOCUMENTS

| | | | |
|---|---|---|---|
| 3,312,563 | 4/1967 | Rusch | 428/908.8 |
| 3,520,771 | 7/1970 | O'Neill et al. | 428/908 |
| 3,700,541 | 4/1971 | Shrimpton et al. | 428/908 |
| 4,097,646 | 6/1978 | Katagiri et al. | 428/323 |
| 4,150,387 | 4/1979 | Miyakawa et al. | 346/153 |
| 4,214,031 | 7/1980 | Miyakawa et al. | 428/213 |
| 4,268,595 | 5/1981 | Katagiri et al. | 428/522 |
| 4,276,334 | 6/1981 | Sugihara | 428/916 |

FOREIGN PATENT DOCUMENTS

| | | |
|---|---|---|
| 0167197 | 10/1983 | Japan . |
| 1240431 | 10/1986 | Japan . |
| 2181337 | 8/1987 | Japan . |
| 1116004 | 6/1968 | United Kingdom . |
| 1348586 | 3/1974 | United Kingdom . |

*Primary Examiner*—George F. Lesmes
*Assistant Examiner*—Beverly A. Pawlikowski
*Attorney, Agent, or Firm*—Cushman, Darby & Cushman

[57] ABSTRACT

An electrostatic recording material comprising a conductive having on at least one side thereof an electroconductive layer and a recording layer in this order is disclosed, wherein said support is made of fabric having a weaving density of at least 30 yarns/cm and a weaving interstice of not more than 150 μm. The recording material exhibits satisfactory recording characteristics and excellent durability, while having a feeling inherent to the fabric.

7 Claims, No Drawings

ELECTROSTATIC RECORDING MATERIAL

FIELD OF THE INVENTION

This invention relates to an electrostatic recording material and, more particularly to an electrostatic recording material comprising a fabric as a support, which has a feeling inherent to the fabric, while exhibiting satisfactory recording characteristics and excellent durability.

BACKGROUND OF THE INVENTION

An electrostatic recording system using an electrostatic recording material has been used in various fields for facsimiles, drafting, correction of the press, printing of official documents, and the like. With the recent development of color recording apparatus to meet the demand for color recording, the electrostatic recording system has been rapidly extending its use. It has been particularly spread in the fields of designs, entertainments, and advertisements because of ease in obtaining color copies. Since the recording materials in these fields are often displayed outdoors from the nature of the business, variety of recording materials other than paper, such as a fabric and a leather, with excellent weather resistance has been keenly demanded.

Conventional electrostatic recording materials generally comprise a paper or synthetic resin film support having thereon an electroconductive layer and a recording layer in this order. Therefore, there is a restriction in handling of a large-area recording material, such as drafts and posters. For example, such a recording material easily develops creases on folding. Besides, general recording materials using paper as a support have disadvantages such as poor durability, particularly against water. However, electrostatic recording materials using a fabric or a leather as a support, which have been under study, fail to have a uniform electroconductive layer and a uniform recording layer, and an electrostatic recording material which has satisfactory recording characteristics while using a fabric or a leather as a support has not yet been developed.

SUMMARY OF THE INVENTION

An object of this invention is to provide an electrostatic recording material comprising a fabric as a support, which has a feeling inherent to the fabric, while satisfying requirements of recording characteristics and durability.

The present invention relates to an electrostatic recording material comprising a support having on at least one side thereof an electroconductive layer and a recording layer in this order, wherein said support is made of a fabric having a weaving density in the range 30 yarns/cm to 50 yarns/cm and a weaving interstice in the range 32 to 150 μm.

In the present invention, use of, as a support, a fabric with a specific structure, having a high weaving density and a narrow weaving interstice between woven yarns, first makes it possible to obtain an electrostatic recording material having a feeling of fabric and satisfactory recording characteristics.

DETAILED DESCRIPTION OF THE INVENTION

Weaving density and weaving interstice of fabric as herein referred to can be determined from a micrograph taken of the fabric surface. The terminology "weaving density" means a number of yarns per unit length counted with eyes in an area of 7 cm×9 cm of a micrograph of 40 magnifications. The terminology "weaving interstice" means an average weaving interstice between adjacent yarns in an area of 7 cm×9 cm of a micrograph of 80 magnifications. When the weaving density or weaving interstice varies between the warp and weft directions, an average of the values of the two directions is obtained.

As to the yarns which constitute the fabric, there are no particular restrictions, and not only spun yarns and filament yarns but mixed yarns of two or more different yarns and yarns having been subjected to various processings are employable. Further, the yarns may be a single yarn or a composite yarn of two or more yarns. In particular, a composite yarns composed of from 10 to 50 yarns is preferred in the present invention.

In the present invention, a fabric prepared by weaving yarns of one or two or more types in various known weaving methods is used as the support.

The material of the fabric as a support is not particularly limited as long as the above-described weaving conditions, i.e., a weaving density in the range 30 yarns/cm to 50 yarns/cm and a weaving interstice in the range 32 to 150 μm, are satisfied For example, sheeting comprising various fibers, e.g., cotton fiber, rayon fiber, acetate fiber, polyester fiber, polyacrylic fiber, and polyamide fiber, can be employed.

If in using a fabric which does not satisfy either one of the two conditions, i.e., which comprises thick woven yarns or has too a large weaving interstice, the resulting electrostatic recording material provides no image of high fineness, failing to exhibit satisfactory recording characteristics due to insufficient denseness. Besides having insufficient denseness, such a fabric lacks in surface smoothness so that it is difficult to form an electroconductive layer and a recording layer thereon.

If desired, the side of the fabric support on which an electroconductive layer and a recording layer are to be formed may be subjected to a smoothness-improving treatment, such as heat calendering, so as to have increased denseness. That is, it is desired that the surface of the fabric on which an electroconductive layer is to be formed is excellent in surface smoothness. The surface smoothness as herein referred to is preferably 5 seconds or longer as measured by means of an Ohken type smoothness meter.

The electroconductive layer which is provided on the fabric surface may be made of any of various known electroconductive substances including ion electroconductive substances and electron electroconductive substances. Examples of a suitable electroconductive layer include a film comprising a cationic or anionic high-molecular electrolyte as a main component and, if desired, an inorganic pigment (e.g., silica, aluminum hydroxide, aluminum oxide, kaolin, talc, mica, calcium carbonate, calcium sulfate, and zeolite), an organic pigment (e.g., a cellulose powder, a polyethylene powder, and a polypropylene powder), and a water-soluble high polymer (e.g., starch and polyvinyl alcohol); a film comprising a resin of various kinds (e.g., polyester resins, (meth)acrylate resins, styrene resins, urethane resins, rubber polymers, epoxy resins, and melamine resins) as a binder having dispersed therein an electroconductive fine powder of, e.g., carbon black, graphite, tin oxide, titanium oxide, zinc oxide, antimony oxide, gold, silver, copper, or nickel; and a metal deposit formed by vacuum evaporation or sputtering of, e.g., gold, aluminum, platinum, indium, tin, palladium-platinum, or tin-antimony oxide. The electroconductive layer preferably has a surface resistance of from $1.0\times10^5$ to $1.0\times10^9$ Ω.

The recording layer which is provided on the electroconductive layer may be made of various resins which are soluble in organic solvents and have high insulation resistance to serve as a dielectric layer. Examples of such resins are polyesters, polycarbonates, polyamides, polyurethanes, (meth)acrylic resins, styrene resins, olefin resins, silicone resins, and fluorocarbon resins. If desired, the recording layer may contain inorganic or organic pigments as used in the above-described electroconductive layer.

The electrostatic recording material of the present invention can be produced by successively forming the above-described electroconductive layer and recording layer on the support in this order. For layer formation, a coating composition comprising the above-described materials for each layer, if desired, dissolved or dispersed in an appropriate solvent (e.g., water, methanol, ethanol, toluene, acetone, methyl ethyl ketone, and ethyl acetate) is coated by means of an air knife coater, a roll coater, a wire bar coater, a spray coater, a fountain coater, a reverse-roll coater, etc. and then dried.

If desired, a barrier layer may be provided between the support and the electroconductive layer and/or on the back side of the support (opposite to the electroconductive layer) having the electroconductive layer and recording layer on only one side thereof. Materials of the barrier layer are not particularly limited, and various known resins of emulsion type can be used. Suitable resins include styrene-butadiene copolymers, acrylic acid-acrylate copolymers, styrene-acrylate copolymers, vinyl acetate-acrylate copolymers, polyvinyl chloride, and vinyl chloride-vinyl acetate copolymers. The barrier layer may further contain inorganic or organic pigments or electroconductive pigments as used in the above-described electroconductive layer.

The present invention is now illustrated in greater detail with reference to Examples, but it should be understood that the present invention is not deemed to be construed as being limited thereto. All the parts and percents are by weight unless otherwise indicated.

EXAMPLE 1

A coating composition having the following formulation was coated on a heat calendered polyester fabric as a support (weaving density: 45/cm; weaving interstice: 50 μm; thickness: about 106 μm; surface smoothness: 8 seconds) to a coverage of 15 g/m² and dried to form an electroconductive layer.

| | |
|---|---|
| Electroconductive zinc oxide ("23-K" produced by Hakusui Chemical Co., Ltd.) | 70 parts |
| Polyester resin ("Vylon MT-240" produced by Toyobo Co., Ltd.: solids content: 40%) | 75 parts |
| Toluene | 55 parts |
| Methyl ethyl ketone | 50 parts |

A coating composition for a recording layer having the following formulation was then coated on the electroconductive layer to a coverage of 7 g/m² and dried to obtain an electrostatic recording material.

| | |
|---|---|
| Calcium carbonate ("Silver W" produced by Shiraishi Calcium Co., Ltd.) | 50 parts |
| Polyester resin ("Vylon 240", solids content: 40%) | 125 parts |
| Toluene | 40 parts |
| Methyl ethyl ketone | 35 parts |

EXAMPLE 2

An electrostatic recording material was produced in the same manner as in Example 1, except that a coating composition comprising a styrene-butadiene copolymer emulsion ("JSR 0697" produced by Nippon Synthetic Rubber Co., Ltd.; solids content: 48%) was coated on the support and dried to form a barrier layer to a coverage of 8 g/m² before providing the electroconductive layer.

EXAMPLES 3 TO 6 AND COMPARATIVE EXAMPLES 1 TO 4

Electrostatic recording materials were produced in the same manner as in Example 1, except for using each of the fabric supports shown in Table 1 below.

TABLE 1

| Example No. | Material | Weaving Density (number of yarns/cm) | Weaving Interstice (μm) | Thickness (μm) | Surface Smoothness (sec) |
|---|---|---|---|---|---|
| Example 3 | polyester | 40 | 45 | 103 | 10 |
| Example 4 | acetate | 34 | 50 | 162 | 40 |
| Example 5 | cotton | 50 | 125 | 176 | 5 |
| Example 6 | nylon | 35 | 32 | 104 | 30 |
| Comparative Example 1 | hemp | 31 | 250 | 251 | 3 |
| Comparative Example 2 | polyester | 25 | 100 | 259 | 30 |
| Comparative Example 3 | cotton | 20 | 150 | 130 | 0 |
| Comparative Example 4 | cotton | 22 | 180 | 180 | 50 |

COMPARATIVE EXAMPLE 5

An electrostatic recording material was produced in the same manner as in Example 1, except for using wood-free paper ("Bright Form" produced by Taio Paper Mfg. Co., Ltd.; basis weight: 52.3 g/m²) as a support.

For evaluation, electrostatic recording was conducted on each of the electrostatic recording materials obtained in Examples 1 to 6 and Comparative Examples 1 to 5 by means of an electrostatic color plotter ("CE 3436" manufactured by Versatec Co.). As a result, any of the recording materials according to the present invention formed a satisfactory image of high precision. On the other hand, the recording materials of Comparative Examples 1 to 4 did not form an image of high precision, only providing an image poor in density and reproducibility. Although the recording material of Comparative Example 5 provided a highly precise image, it had, as a matter of course, no feeling of fabric and was easily creased on folding, while the recording materials of Examples 1 to 6 could be folded without leaving any crease. Further, when the recording materials were dipped in water, none of those of Examples 1 to 6 caused any problem for 1 week or longer, whereas that of Comparative Example 5 underwent partial separation between the support and the electroconductive layer on standing in water for 1 day.

It was thus proved that the electrostatic recording material according to the present invention has satisfactory recording characteristics and excellent durability.

As described above, since the electrostatic recording material of the present invention has a support comprising a fabric of specific weaving structure, it possesses satisfactory recording characteristics, crease resistance on folding, and excellent durability particularly against water while retaining a feeling inherent to the fabric.

While the invention has been described in detail and with reference to specific embodiments thereof, it will be apparent to one skilled in the art that various changes and modifications can be made therein without departing from the spirit and scope thereof.

What is claimed is:

1. An electrostatic recording material comprising a support having on at least one side thereof an electroconductive layer and a recording layer in this order, wherein said support is made of a fabric having a weaving density in the range 30 yarns/cm to 50 yarns/cm and a weaving interstice in the range 32 to 150 μm.

2. An electrostatic recording material as in claim 1, wherein said fabric is made of a composite yarn composed of from 10 to 50 yarns.

3. An electrostatic recording material as in claim 1, wherein the side of said fabric on which said electroconductive layer and said recording layer are to be formed is subjected to a smoothness-improving treatment.

4. An electrostatic recording material as in claim 1, wherein said fabric has a surface smoothness of 5 seconds or longer as measured by means of an Ohken type smoothness meter.

5. An electrostatic recording material as in claim 3, wherein said fabric has a surface smoothness of 5 seconds or longer as measured by means of an Ohken type smoothness meter.

6. An electrostatic recording material as in claim 1, wherein a barrier layer is provided between said support and said electroconductive layer and/or on the back side of said support having said electroconductive layer and said recording layer on only one side thereof.

7. An electrostatic recording material as claimed in claim 1, wherein the fabric support material is a woven fabric of yarns which are made up of fibers selected from the group consisting of cotton fiber, rayon fiber, acetate fiber, polyester fiber, polyacrylic fiber and polyamide fiber.

* * * * *